US012716201B2

(12) United States Patent
Yanase et al.

(10) Patent No.: US 12,716,201 B2
(45) Date of Patent: Aug. 25, 2026

(54) CONSTRUCTION MACHINE

(71) Applicant: HITACHI CONSTRUCTION MACHINERY CO., LTD., Tokyo (JP)

(72) Inventors: Yoshitaka Yanase, Tsuchiura (JP); Hajime Okano, Nagareyama (JP); Yuuji Murayama, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 342 days.

(21) Appl. No.: 18/689,883

(22) PCT Filed: Mar. 27, 2023

(86) PCT No.: PCT/JP2023/012281
§ 371 (c)(1),
(2) Date: Mar. 7, 2024

(87) PCT Pub. No.: WO2023/190379
PCT Pub. Date: Oct. 5, 2023

(65) Prior Publication Data

US 2025/0129572 A1 Apr. 24, 2025

(30) Foreign Application Priority Data

Mar. 29, 2022 (JP) ..... 2022-053302

(51) Int. Cl.
*E02F 9/22* (2006.01)
*E02F 3/32* (2006.01)
(Continued)

(52) U.S. Cl.
CPC ..... *E02F 9/2242* (2013.01); *E02F 9/2275* (2013.01); *E02F 9/2289* (2013.01);
(Continued)

(58) Field of Classification Search
CPC ..... F15B 11/17; E02F 9/0866; E02F 9/2239; E02F 9/2242; E02F 9/2275
See application file for complete search history.

(56) References Cited

U.S. PATENT DOCUMENTS 9,783,960 B2 * 10/2017 Shimizu ..... E02F 9/2267
10,370,824 B2 * 8/2019 Hiraku ..... E02F 9/2292
(Continued)

FOREIGN PATENT DOCUMENTS

JP 2-11851 U 1/1990
JP 11-124879 A 5/1999
(Continued)

OTHER PUBLICATIONS

International Search Report of PCT/JP2023/012281 dated Apr. 25, 2023.

*Primary Examiner* — Michael Leslie
(74) *Attorney, Agent, or Firm* — MATTINGLY & MALUR, PC

(57) ABSTRACT

A closed-circuit pipe group (30) that constitutes a closed circuit system (25 to 28) is distributed through upper positions of a closed-circuit hydraulic pump (29) and an open-circuit hydraulic pump (35) along an upper surface plate (22) of a housing (20). Further, an open-circuit pipe group (36) that constitutes an open circuit system (31 to 34) is distributed through lower positions of the closed-circuit hydraulic pump (29) and the open-circuit hydraulic pump (35) along a revolving frame (8). Therefore, a working space for performing operational work can be formed between the closed-circuit pipe group (30) and the open-circuit pipe group (36).

5 Claims, 5 Drawing Sheets

(51) Int. Cl.
*E02F 3/42* (2006.01)
*E02F 9/08* (2006.01)

(52) U.S. Cl.
CPC ..... *E02F 9/2292* (2013.01); *E02F 3/32* (2013.01); *E02F 3/425* (2013.01); *E02F 9/0866* (2013.01); *E02F 9/2296* (2013.01)

(56) References Cited

U.S. PATENT DOCUMENTS

| | | | | |
|---|---|---|---|---|
| 11,111,651 | B2 * | 9/2021 | Shimizu | F15B 11/17 |
| 2017/0073931 | A1 | 3/2017 | Hiraku et al. | |
| 2022/0282458 | A1 | 9/2022 | Vanderlaan | |
| 2025/0019922 | A1 * | 1/2025 | Okano | E02F 9/02 |
| 2025/0137231 | A1 * | 5/2025 | Okano | F15B 13/0807 |

FOREIGN PATENT DOCUMENTS

| | | | |
|---|---|---|---|
| JP | 2002-121765 | A | 4/2002 |
| JP | 2015-227544 | A | 12/2015 |
| WO | 2021/066892 | A1 | 4/2021 |

* cited by examiner

CONSTRUCTION MACHINE

TECHNICAL FIELD

The present disclosure relates to a construction machine such as a hydraulic excavator, and more particularly, to a construction machine with a closed circuit system performing closed circuit connection between a hydraulic pump and a hydraulic actuator.

BACKGROUND ART

Typically, a hydraulic excavator serving as a representative type of construction machine is configured to operate a hydraulic actuator by driving a hydraulic pump with a prime mover and supplying hydraulic oil discharged from the hydraulic pump (pressurized oil) to the hydraulic actuator.

Associated known systems operating a hydraulic actuator with hydraulic oil discharged from a hydraulic pump include closed circuit systems and open circuit systems. A closed circuit system is composed of a closed-circuit hydraulic pump driven by a prime mover and a plurality of closed-circuit pipes connecting the closed-circuit hydraulic pump and a hydraulic actuator. An open circuit system is composed of an open-circuit hydraulic pump driven by a prime mover and a plurality of open-circuit pipes connecting the open-circuit hydraulic pump and a plurality of closed-circuit pipes (Patent Document 1).

PRIOR ART DOCUMENT

Patent Document

Patent Document 1: Japanese Patent Laid-Open No. 2015-227544 A

SUMMARY OF THE INVENTION

In fact, a closed circuit system requires two closed-circuit pipes circulating hydraulic oil between a hydraulic pump and a hydraulic actuator. Specifically, for example, the operation of four hydraulic actuators of a hydraulic excavator: a boom cylinder, an arm cylinder, a bucket cylinder, and a revolving motor in a closed circuit system needs at least four closed-circuit hydraulic pumps and eight closed-circuit pipes. In addition, as disclosed in Patent Document 1, a plurality of open-circuit pipes for operating a traveling hydraulic motor is required even in a case where a drive system of a traveling device is configured by an open circuit pump.

Therefore, numerous hydraulic pipes are disposed between a plurality of hydraulic pumps and a control valve device controlling a plurality of hydraulic actuators. Unfortunately, such numerous hydraulic pipes extending between a plurality of hydraulic pumps and a control valve device are an obstacle to maintenance of the hydraulic pumps or the control valve device, failing to secure a working space and resulting in low operational efficiencies for maintenance and other operations.

In view of the above-described problems of conventional technologies, an object of the present invention is to provide a construction machine capable of securing a working space and improving the operational efficiency by simplifying the arrangement of a closed-circuit pipe group and an open-circuit pipe group.

A construction machine according to the present invention includes: a vehicle body frame; a working mechanism provided on the vehicle body frame; a prime mover provided on the vehicle body frame; a housing with an upper structure covering the prime mover from above; a hydraulic actuator driving the working mechanism; a closed circuit system including a closed-circuit hydraulic pump driven by the prime mover and a closed-circuit pipe group composed of a plurality of closed-circuit pipes connecting the closed-circuit hydraulic pump and the hydraulic actuator; and an open circuit system including an open-circuit hydraulic pump driven by the prime mover and an open-circuit pipe group composed of a plurality of open-circuit pipes connecting the open-circuit hydraulic pump and the plurality of closed-circuit pipes, characterized in that one pipe group of the closed-circuit pipe group and the open-circuit pipe group is distributed through upper positions of the closed-circuit hydraulic pump and the open-circuit hydraulic pump along the upper structure, and the other pipe group is distributed through lower positions of the closed-circuit hydraulic pump and the open-circuit hydraulic pump along the vehicle body frame.

According to the present invention, the arrangement of a closed-circuit pipe group and an open-circuit pipe group can be simplified to secure a working space and improve the operational efficiency.

MODE FOR CARRYING OUT THE INVENTION

A representative type of construction machine according to an embodiment of the present invention, by taking the case of a hydraulic excavator, will be explained in detail with reference to FIGS. 1 to 5.

Figure 1:
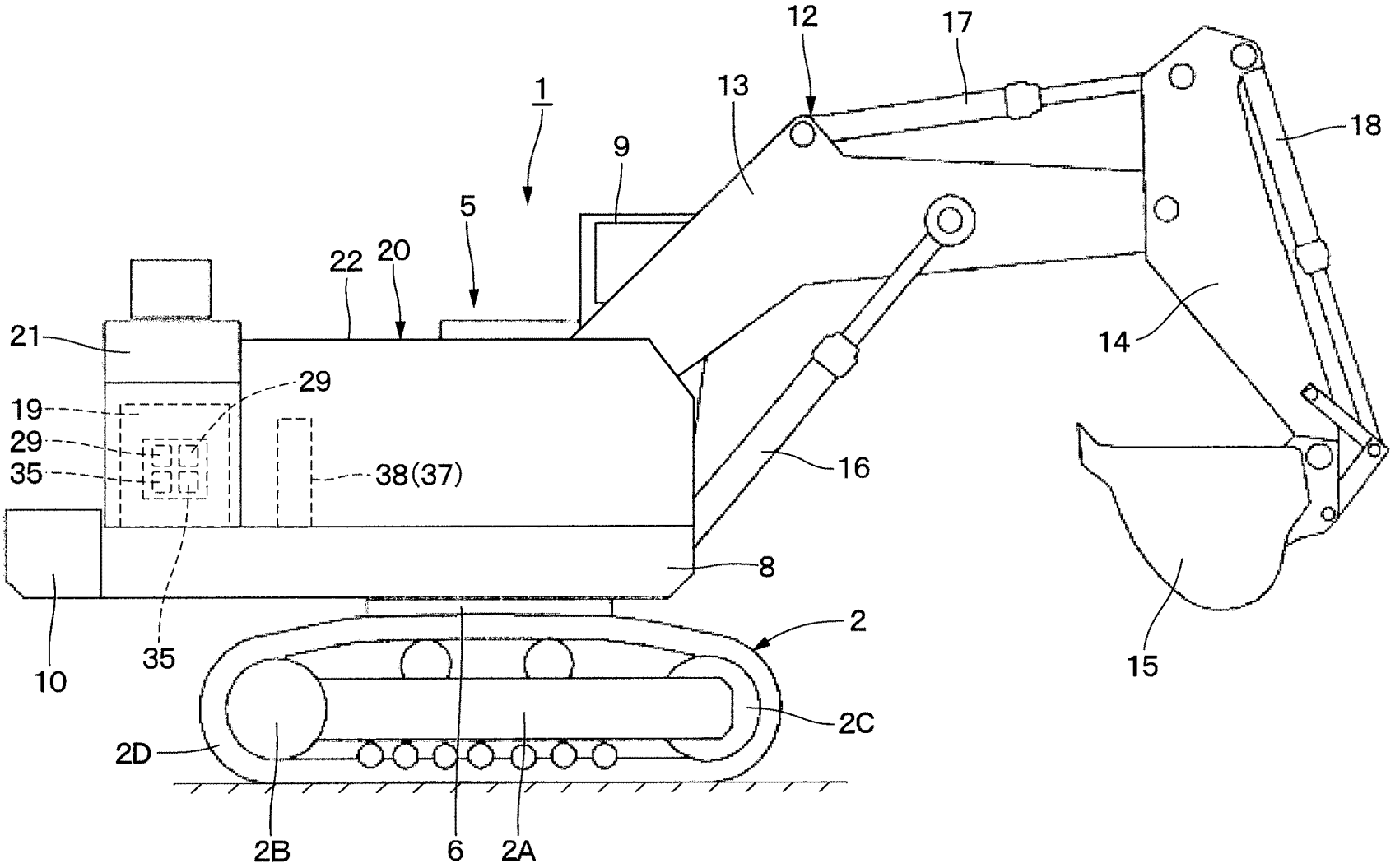
FIG. 1 is a right side view showing a hydraulic excavator according to an embodiment of the present invention.
Figure 2:
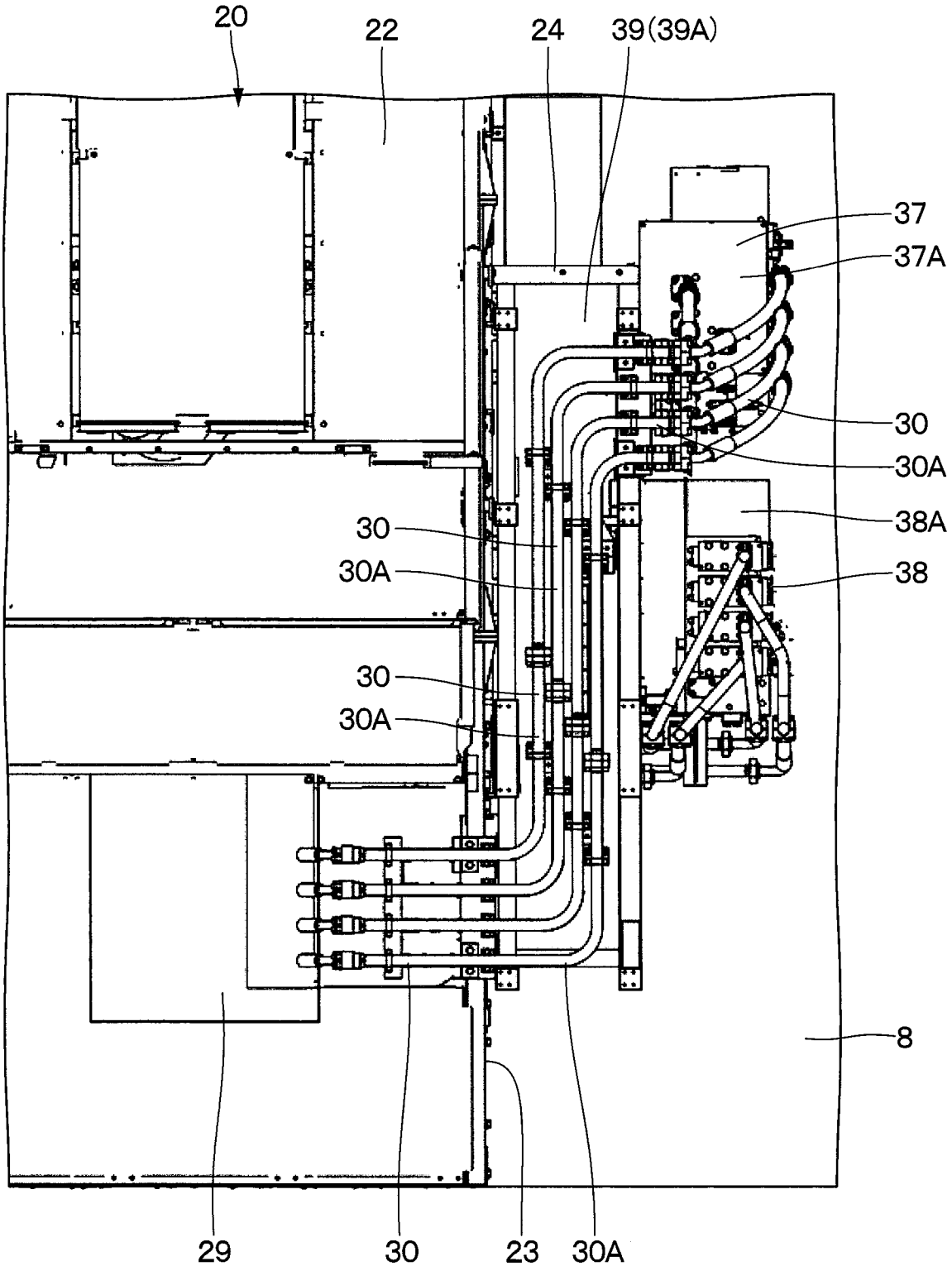
FIG. 2 is a plan view showing a rear portion of an upper revolving structure of FIG. 1.

In FIG. 1, a hydraulic excavator 1 serving as a representative type of construction machine is used to perform excavating work of sand and earth. The hydraulic excavator 1 includes a crawler-type self-propelled lower traveling structure 2, an upper revolving structure 5 provided rotatably on the lower traveling structure 2 and constituting a vehicle body together with the lower traveling structure 2, and a later-described working mechanism 12 mounted rotatably on a front side of the upper revolving structure 5. The hydraulic excavator 1 performs excavating work of sand and earth, using the working mechanism 12.

The lower traveling structure 2 is configured to include a truck frame 2A, a drive wheel 2B provided on either right or left side of the truck frame 2A, an idler wheel 2C provided on either right or left side of the truck frame 2A and opposite the drive wheel 2B in the front-rear direction, and a crawler belt 2D looped around the drive wheel 2B and the idler wheel 2C (each shown only on the right side). The left drive wheel is rotatively driven by a left traveling hydraulic motor 3 (see FIG. 5). The right drive wheel 2B is rotatively driven by a right traveling hydraulic motor 4 (see FIG. 5).

Meanwhile, the upper revolving structure 5 is mounted rotatably on the lower traveling structure 2 through a revolving device 6 (see FIG. 1). The revolving device 6 is configured to include a revolving hydraulic motor 7 (see FIG. 5) as a hydraulic actuator, a reduction mechanism, and a revolving bearing. The revolving device 6 (revolving hydraulic motor 7) drives/revolves the upper revolving structure 5 with respect to the lower traveling structure 2.

The upper revolving structure 5 is configured to include a revolving frame 8 as a vehicle body frame constituting a support structure and including a working mechanism 12 mounted on a front side thereof, a cab 9 mounted on a left front side of the revolving frame 8 and forming an operator's room therein, a housing 20 accommodating a later-described engine 19, a closed-circuit hydraulic pump 29, an open-circuit hydraulic pump 35 and the like (see FIG. 3) located on a rear side of the cab 9 and mounted on the revolving frame 8, and a counterweight 10 mounted at a rear portion of the revolving frame 8 and taking a weight balance with the working mechanism 12.

Herein, an operator's seat for an on-board operator to be seated (not shown) is provided inside the cab 9. An operating device 11 operating the hydraulic excavator 1 (see FIG. 5) is provided in front and on the left and right sides of the operator's seat. The operating device 11 is illustrated as one example of a target to be operated and a lever operation combined, and configured to include a left control lever 11A for operating the revolving hydraulic motor 7 and a later-described arm cylinder 17, a right control lever 11B for operating a later-described boom cylinder 16 and a bucket cylinder 18, and left and right traveling levers/pedals 11C, 11D operating the left traveling hydraulic motor 3 and the right traveling hydraulic motor 4, respectively.

The operating device 11 is connected to a later-described controller 41 via signal lines and the like. An operator can operate the operating device 11 to revolve the upper revolving structure 5, rotate the working mechanism 12 and allow the lower traveling structure 2 to travel. For example, the operator can operate the left control lever 11A to expand and contract an arm cylinder 17 and rotate a later-described arm 14. Also, the operator can operate the right control lever 11B to expand and contract a boom cylinder 16 and rotate a later-described boom 13.

As shown in FIG. 1, the working mechanism 12 includes a boom 13 mounted rotatably at a front portion of the revolving frame 8, an arm 14 mounted rotatably on a tip end side of the boom 13, and a bucket 15 mounted rotatably on a tip end side of the arm 14. The boom 13, the arm 14, and the bucket 15 are driven by the boom cylinder 16, the arm cylinder 17, and a bucket cylinder 18, respectively, each composed of a hydraulic cylinder. The boom cylinder 16 allows the boom 13 to rotate with respect to the revolving frame 8, the arm cylinder 17 allows the arm 14 to rotate with respect to the boom 13, and the bucket cylinder 18 allows the bucket 15 to rotate with respect to the arm 14.

The boom cylinder 16, the arm cylinder 17, and the bucket cylinder 18, each as a hydraulic actuator, expand or contract based upon hydraulic oil (pressurized oil) from a later-described closed-circuit hydraulic pump 29 and an open-circuit hydraulic pump 35 to change the posture of the working mechanism 12. That is, the boom cylinder 16, the arm cylinder 17, and the bucket cylinder 18 expand or contract based upon the operation of the left control lever 11A and the right control lever 11B, for example, to rotate the boom 13, the arm 14, and the bucket 15, when the vehicle excavates earth and sand. The resulting operation of the bucket 15 can excavate earth and sand.

Herein, the boom cylinder 16, the arm cylinder 17, and the bucket cylinder 18 are configured as a single rod-type hydraulic cylinder to expand or contract based upon the supply and discharge of hydraulic oil. That is, the boom cylinder 16, the arm cylinder 17, and the bucket cylinder 18 are configured by a tube, a piston slidably inserted into the tube and defining the inside of the tube for a bottom side oil chamber and a rod side oil chamber, and a rod whose base end side is mounted on the piston and whose tip end side projects out of the tube.

Figure 3:
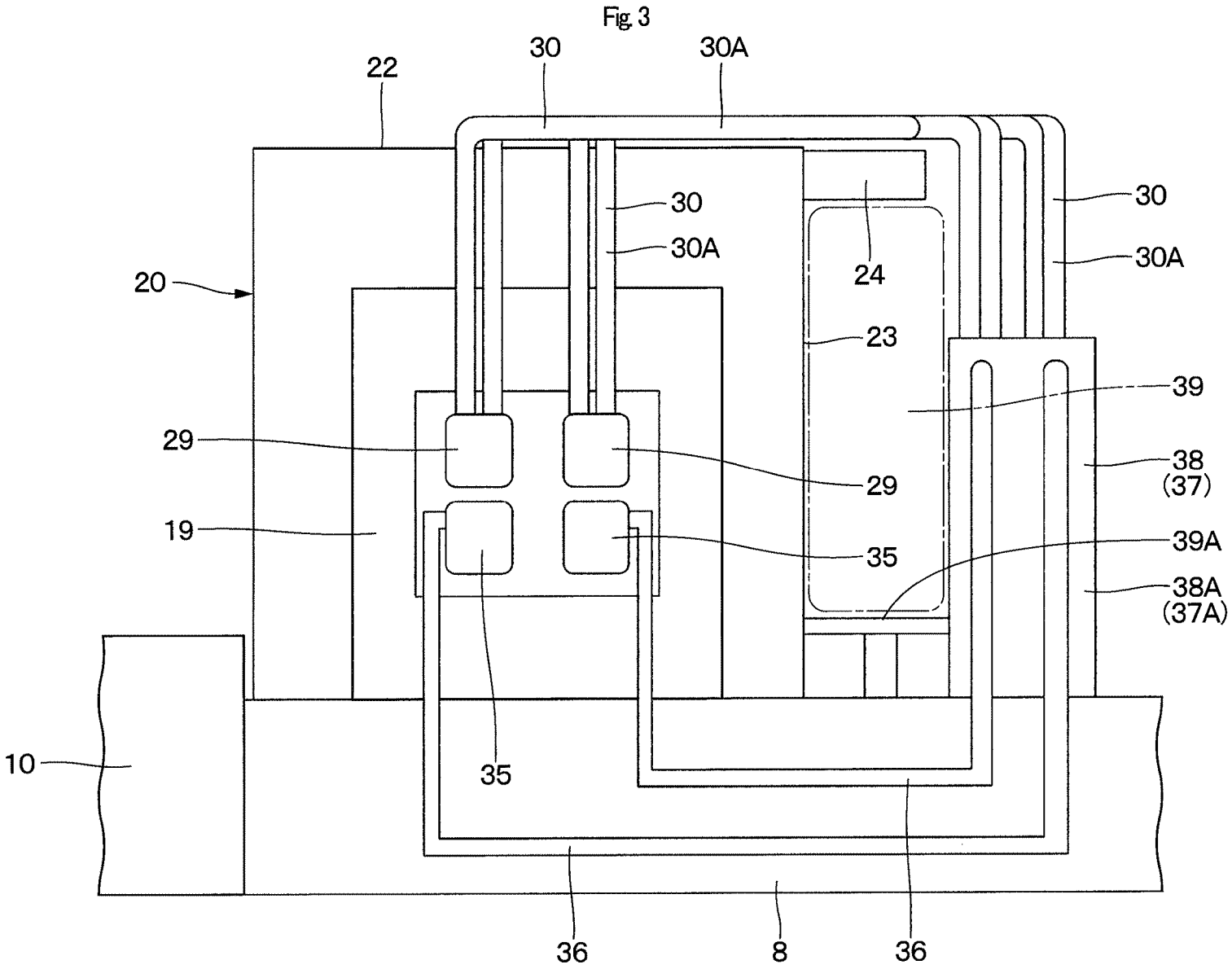
FIG. 3 is a right side view showing the rear portion of the upper revolving structure.

As shown in FIG. 3, an engine 19, as a prime mover, is located on a front side of the counterweight 10 and provided on the revolving frame 8. The engine 19 is configured as a diesel engine, for example. One engine 19 is transversely provided to extend in the right-and-left direction on a rear side of the revolving frame 8. For example, a plurality of closed-circuit hydraulic pumps 29, a plurality of open-circuit hydraulic pumps 35 and others are mounted on the right side of the engine 19. An output shaft of the engine 19 is connected to the plurality of closed-circuit hydraulic pumps 29, the plurality of open-circuit hydraulic pumps 35 and others via a gear mechanism and the like. A heat exchanger (not shown; e.g., a radiator, an oil cooler, and a condenser) is disposed on the left side of the engine 19.

The prime mover may be a single electric motor, or a hybrid type prime mover composed of a diesel engine and an electric motor combined. Meanwhile, the prime mover may be configured to be longitudinally provided to extend in the front-rear direction of the upper revolving structure 5, or such two prime movers may be disposed in parallel in the right-and-left direction.

The housing 20 is provided on the revolving frame 8 so as to cover apparatuses including the engine 19, the closed-circuit hydraulic pumps 29, the open-circuit hydraulic pumps 35 and the heat exchanger. The housing 20 is configured to include a left side plate (not shown), a right side plate 21 and an upper surface plate 22. In addition, the housing 20 has a front surface plate 23 covering a front side of the engine 19. The upper surface plate 22 constitutes an upper structure, and is formed, for example, by mounting iron plates and other materials on frameworks composed of a plurality of steel materials.

Figure 4:
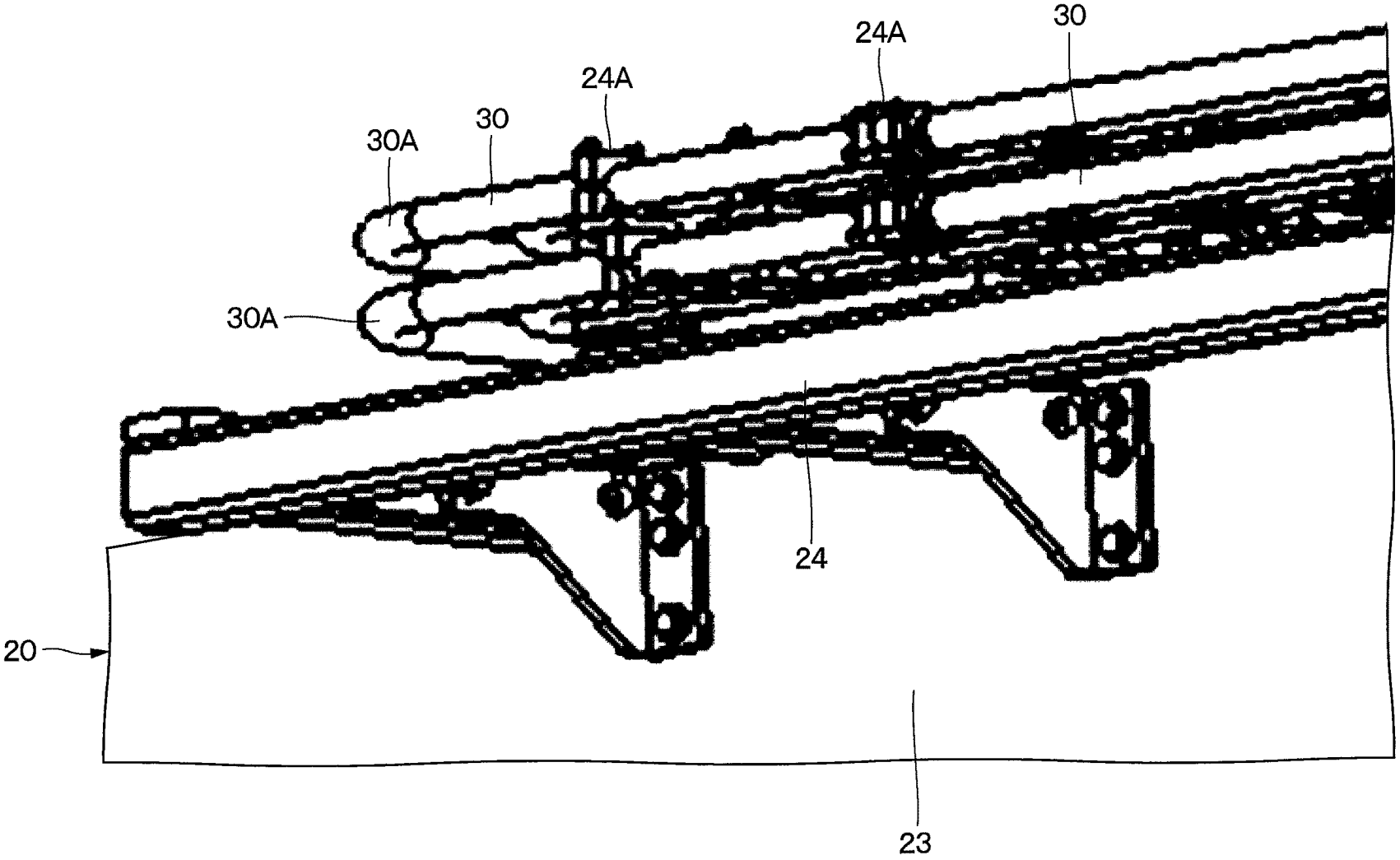
FIG. 4 is a perspective view showing a closed-circuit pipe group supported by a support frame.
Figure 5:
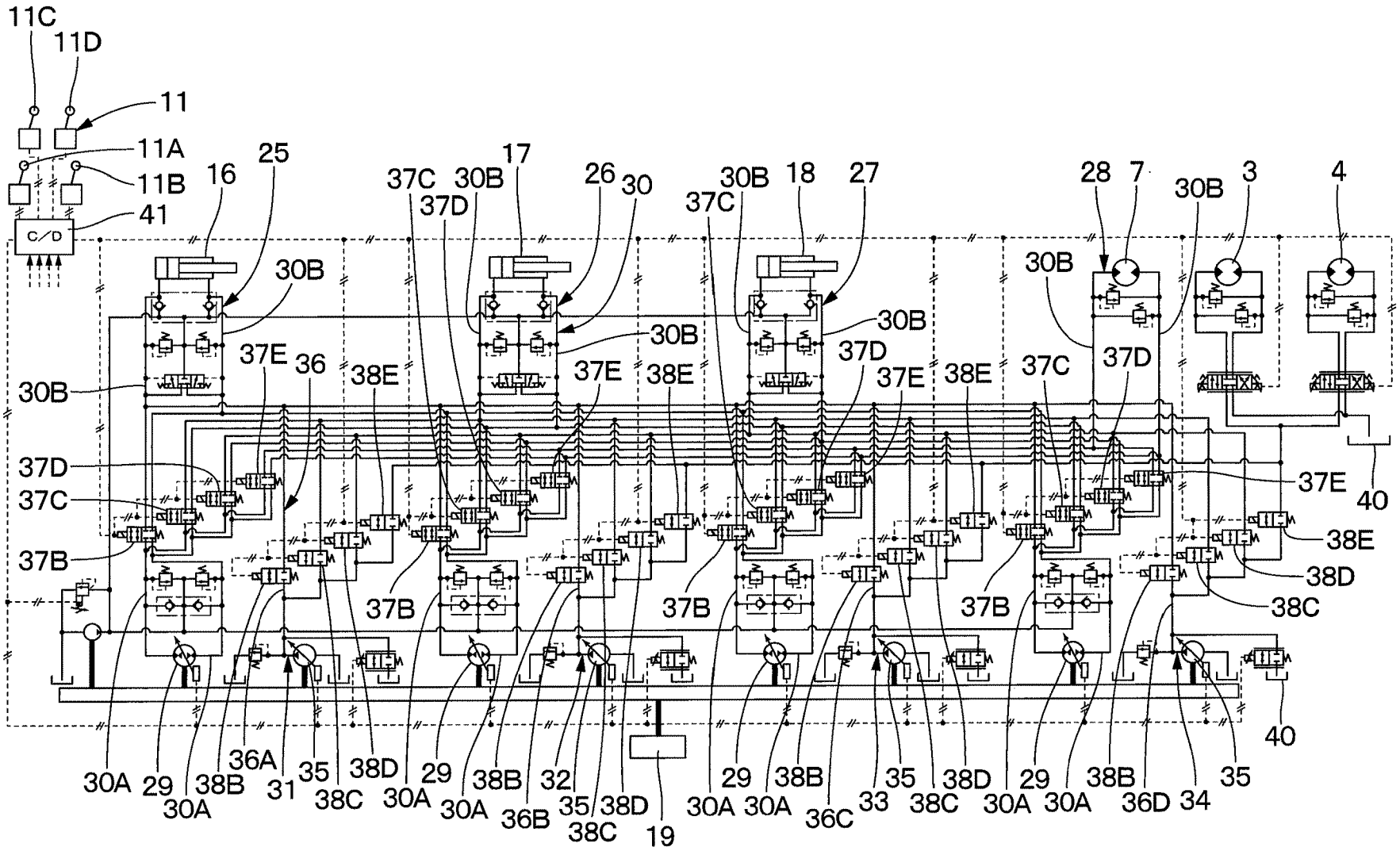
FIG. 5 is a hydraulic circuit diagram of the hydraulic excavator.

The housing 20 has a support frame 24 (see FIG. 2) at a front position of the upper surface plate 22. The support frame 24 is formed as a strength material. Specifically, as shown in FIG. 4, the support frame 24 is formed as a lengthy rectangular frame body in the right-and-left direction, using steel materials such as pipes, angle members, channel members, for example, and a rear edge portion thereof is mounted at an upper position of the front surface plate 23. As shown in FIG. 3, the support frame 24 is placed on a front side of the upper surface plate 22 in the form of a canopy to cover an upper side of a working passage 39 provided between the engine 19, a later-described closed-circuit control valve device 37 and an open-circuit control valve device 38. Further, a closed-circuit pipe group 30 is mounted on an upper side of the support frame 24.

Next, the configuration of closed circuit systems 25 to 28 and open circuit systems 31 to 34 will be described.

In this embodiment, a hydraulic system of the hydraulic excavator 1 is configured to allow a closed-circuit control valve device 37 to connect any one closed-circuit hydraulic pump 29 to any one hydraulic actuator in the form of a closed circuit (to configure a closed circuit) between four closed-circuit hydraulic pumps 29, and four hydraulic actuators: the boom cylinder 16, the arm cylinder 17, the bucket cylinder 18 and the revolving hydraulic motor 7. Then, a controller 41 controls the closed-circuit control valve device 37, depending on the situations of operations and work, to control the switching between each of the hydraulic actuators and each of the closed-circuit hydraulic pumps 29.

In this embodiment, the case where each of the closed-circuit hydraulic pumps 29 is connected to each of the hydraulic actuators to configure four closed circuit systems will be described. Specifically, the closed circuit system 25 is a hydraulic system for driving the boom cylinder 16. The closed circuit system 26 is a hydraulic system for driving the arm cylinder 17. The closed circuit system 27 is a hydraulic system for driving the bucket cylinder 18. Further, the closed circuit system 28 is a hydraulic system for driving the revolving hydraulic motor 7. The configuration of these four most simplified closed circuit systems 25 to 28 will be described.

The closed circuit system 25 includes the closed-circuit hydraulic pumps 29 driven by the engine 19 and the closed-circuit pipe group 30 connecting the closed-circuit hydraulic pumps 29 and the boom cylinder 16. In addition, the closed circuit system 25 is provided with a later-described plurality of switching valves 37B to 37E of the closed-circuit control valve device 37 (see FIG. 5) in the course of the closed-circuit pipe group 30. The closed-circuit pipe group 30 is formed of a metal pipe and a hose combined, for example.

Herein, the configuration of the closed circuit systems 26 to 28 is generally the same as that of the closed circuit system 25. Thus, in the closed circuit systems 26 to 28, the component elements that are identical to those of the closed circuit system 25 will be denoted by the same reference numerals to avoid repetitions of similar explanations.

As shown in FIG. 3, a plurality of, for example, four closed-circuit hydraulic pumps 29 that constitute the closed circuit systems 25 to 28 are located upward from a later-described open-circuit hydraulic pump 35 and mounted on the right side of the engine 19. Four closed-circuit hydraulic pumps 29 are configured by a swash plate type variable displacement hydraulic pump, an inclined shaft type hydraulic pump or a radial piston type hydraulic pump, for example. FIG. 3 illustrates the case where the four closed-circuit hydraulic pumps 29 are placed such that they are divided into two pairs of two pumps, with the paired pumps connected in series in the right-and-left direction, and the two pairs are arranged in parallel in the front-rear direction. Such four closed-circuit hydraulic pumps 29 may be arranged otherwise.

The closed-circuit pipe group 30 is configured to include a pair of two pump side pipes 30A and a pair of two actuator side pipes 30B. The pump side pipe 30A and the actuator side pipe 30B constitute a closed-circuit pipe. The pump side pipe 30A connects the closed-circuit hydraulic pump 29 for the boom cylinder 16 and a later-described closed-circuit control valve device 37. The actuator side pipe 30B connects the closed-circuit control valve device 37 and the boom cylinder 16 (bottom side oil chamber, rod side oil chamber).

The pump side pipe 30A of the closed-circuit pipe group 30 of the closed circuit system 26 connects the closed-circuit hydraulic pump 29 for the arm cylinder 17 and the closed-circuit control valve device 37. The actuator side pipe 30B of the closed-circuit pipe group 30 of the closed circuit system 26 connects the closed-circuit control valve device 37 and the arm cylinder 17. The pump side pipe 30A of the closed-circuit pipe group 30 of the closed circuit system 27 connects the closed-circuit hydraulic pump 29 for the bucket cylinder 18 and the closed-circuit control valve device 37. The actuator side pipe 30B of the closed-circuit pipe group 30 of the closed circuit system 27 connects the closed-circuit control valve device 37 and the bucket cylinder 18. Further, the pump side pipe 30A of the closed-circuit pipe group 30 of the closed circuit system 28 connects the closed-circuit hydraulic pump 29 for the revolving hydraulic motor 7 and the closed-circuit control valve device 37. The actuator side pipe 30B of the closed-circuit pipe group 30 of the closed circuit system 28 connects the closed-circuit control valve device 37 and the revolving hydraulic motor 7.

As described above, in this embodiment, it is possible to optionally switch the connection of any closed-circuit hydraulic pump 29 to any hydraulic actuator. Therefore, any closed-circuit hydraulic pump 29 and the pump side pipe 30A connected to the closed-circuit hydraulic pump 29 can selectively be connected to various hydraulic actuators, depending on the state of the closed-circuit control valve device 37.

Herein, the route of distribution for a closed-circuit pipe group 30, totaling eight pump side pipes 30A, composed of four pairs of two pipes for the four closed circuit systems 25 to 28, respectively, will be described. As shown in FIG. 3, a closed-circuit pipe group 30 as one pipe group, that is, composed of eight pump side pipes 30A, is distributed through upper positions of the closed-circuit hydraulic pump 29 and the open-circuit hydraulic pump 35 along the upper surface plate 22 as an upper structure. Specifically, the eight pump side pipes 30A extend upward from the corresponding closed-circuit hydraulic pump 29, protrude through an upper surface of the upper surface plate 22 of the housing 20, bend and extend forward, bend beyond the support frame 24 and extend downward, and a tip end thereof is connected to the closed-circuit control valve device 37. As a result, a later-described foothold 39A forming the working passage 39 can be provided on lower sides of the eight pump side pipes 30A. A viable disassembly of the pump side pipe 30A from between the working passage 39 and the closed-circuit control valve device 37 allows an operator to readily reach the closed-circuit control valve device 37 from the working passage 39.

Further, as shown in FIG. 4, the eight pump side pipes 30A are supported (fixed) to the support frame 24 at an upper position thereof, using a clamp member 24A. As a result, the eight pump side pipes 30A can firmly be fixed to the upper surface plate 22.

Next, the open circuit system 31 is a hydraulic system for compensating for hydraulic oil relative to the closed circuit system 25. The open circuit system 32 is a hydraulic system for compensating for hydraulic oil relative to the closed circuit system 26. The open circuit system 33 is a hydraulic system for compensating for hydraulic oil relative to the closed circuit system 27. Further, the open circuit system 34 is a hydraulic system for compensating for hydraulic oil relative to the closed circuit system 28. In addition, each of the open circuit systems 31 to 34 supplies pressurized oil to the left and right traveling hydraulic motors 3, 4.

The open circuit system 31 includes the open-circuit hydraulic pump 35 driven by the engine 19 and an open-circuit pipe 36A connecting the open-circuit hydraulic pump 35 and the actuator side pipe 30B of the closed-circuit pipe group 30 of the closed circuit system 25. Also, the open circuit system 31 includes a later-described plurality of switching valves 38B to 38E (see FIG. 5) of the open-circuit control valve device 38 in the course of the open-circuit pipe 36A. The open-circuit pipe 36A constitutes an open-circuit pipe group 36 together with later-described open-circuit pipes 36B to 36D. Open-circuit pipes 36A to 36D are formed of a metal pipe and a hose combined, for example.

Herein, the configuration of the open circuit systems 32 to 34 is generally the same as that of the open circuit system 31. Thus, in the open circuit systems 32 to 34, the component elements that are identical to those of the open circuit system 31 will be denoted by the same reference numerals to avoid repetitions of similar explanations.

As shown in FIG. 3, a plurality of, for example, 4 open-circuit hydraulic pumps 35 that constitute the open circuit systems 31 to 34 are located downward from the closed-circuit hydraulic pump 29 and mounted on the right side of the engine 19. Four open-circuit hydraulic pumps 35 are configured by a swash plate type variable displacement hydraulic pump, an inclined shaft type hydraulic pump or a radial piston type hydraulic pump, for example. FIG. 3 illustrates the case where the four open-circuit hydraulic pumps 35 are placed such that they are divided into two pairs of two pumps, with the paired pumps connected in series in the right-and-left direction, and the two pairs are arranged in parallel in the front-rear direction. Such four open-circuit hydraulic pumps 35 may be arranged otherwise.

The four open-circuit hydraulic pumps 35 that constitute the open circuit systems 31 to 34 supply pressurized oil to the left traveling hydraulic motor 3 and the right traveling hydraulic motor 4 via switching valves 38B to 38E.

The open-circuit pipe 36B of the open circuit system 32 connects the open-circuit hydraulic pump 35 and the actuator side pipe 30B of the closed-circuit pipe group 30 of the closed circuit system 26. In addition, a plurality of switching valves 38B to 38E is provided in the course of the open-circuit pipe 36B of the open circuit system 32. The open-circuit pipe 36C of the open circuit system 33 connects the open-circuit hydraulic pump 35 and the actuator side pipe 30B of the closed-circuit pipe group 30 of the closed circuit system 27. A plurality of switching valves 38B to 38E is provided in the course of the open-circuit pipe 36C of the open circuit system 33. Further, the open-circuit pipe 36D of the open circuit system 34 connects the open-circuit hydraulic pump 35 and the actuator side pipe 30B of the closed-circuit pipe group 30 of the closed circuit system 28. A plurality of switching valves 38B to 38E is provided in the course of the open-circuit pipe 36D of the open circuit system 34.

Herein, the route of distribution for the open-circuit pipe group 36, totaling four open-circuit pipes 36A to 36D, each provided for each of the open circuit systems 31 to 34, will be described. As shown in FIG. 3, the open-circuit pipe group 36 as the other pipe group, that is, composed of four open-circuit pipes 36A to 36D, is distributed through lower positions of the closed-circuit hydraulic pump 29 and the open-circuit hydraulic pump 35 along the revolving frame 8 as a vehicle body frame. Specifically, the four open-circuit pipes 36A to 36D extend downward from the corresponding open-circuit hydraulic pump 35, bend at a position lower than an upper surface of the revolving frame 8 and extend forward, bend beyond the working passage 39 and extend upward, and a tip end thereof is connected to the open-circuit control valve device 38. As a result, the working passage 39 can be formed on upper sides of the four open-circuit pipes 36A to 36D. A viable disassembly of the open-circuit pipes 36A to 36D from between the working passage 39 and the open-circuit control valve device 38 allows an operator to readily reach the open-circuit control valve device 38 from the working passage 39.

In this way, in this embodiment, the closed-circuit pipe group 30 is distributed through upper positions of the closed-circuit hydraulic pump 29 and the open-circuit hydraulic pump 35 along the upper surface plate 22 of the housing 20, and the open-circuit pipe group 36 is distributed through lower positions of the closed-circuit hydraulic pump 29 and the open-circuit hydraulic pump 35 along the revolving frame 8. As a result, a space can be formed between the closed-circuit pipe group 30 and the open-circuit pipe group 36, which is defined between the front surface plate 23 of the housing 20, closed-circuit control valve device 37, and the open-circuit control valve device 38. The space is a working space including a later-described working passage 39.

The closed-circuit control valve device 37 and the open-circuit control valve device 38 are provided on the revolving frame 8 to be spaced apart forward from the front surface plate 23 of the housing 20, for example, arranged in parallel in the right-and-left direction. The closed-circuit control valve device 37 and the open-circuit control valve device 38 are arranged such that the former is located on the left side, and the latter is located on the right side, for example.

The closed-circuit control valve device 37 is composed of a block-shaped structure that is thin in the front-rear direction, including a manifold 37A (see FIG. 2) in which a plurality of passages circulating hydraulic oil are formed and a plurality of switching valves 37B to 37E (see FIG. 5) mounted on the manifold 37A. The switching valves 37B to 37E are provided in the course of the closed-circuit pipe group 30 of the closed circuit systems 25 to 28.

The open-circuit control valve device 38 is composed of a block-shaped structure that is thin in the front-rear direction, including a manifold 38A (see FIGS. 2 and 3) in which a plurality of passages circulating hydraulic oil inside are formed and a plurality of switching valves 38B to 38E (see FIG. 5) mounted on the manifold 38A. The switching valves 38B to 38E are provided in the course of the open-circuit pipe group 36 of the open circuit systems 31 to 34.

A working passage 39 is a space for allowing an operator to work that is formed to extend in the right-and-left direction between the front surface plate 23 of the housing 20, the closed-circuit control valve device 37 and the open-circuit control valve device 38, which is defined between the closed-circuit pipe group 30 and the open-circuit pipe group 36. A foothold 39A that constitutes the working passage 39 faces the apparatuses such as the engine 19, the closed-circuit hydraulic pump 29, the open-circuit hydraulic pump 35, the closed-circuit control valve device 37, and the open-circuit control valve device 38. As a result, an operator in the working passage 39 can readily reach these apparatuses.

A hydraulic oil tank 40 is disposed on the revolving frame 8 to reserve hydraulic oil to be supplied to the open-circuit hydraulic pump 35 and the like. In addition, the controller 41 is connected to the operating device 11, the plurality of switching valves 37B to 37E of the closed-circuit control valve device 37 and the switching valves 38B to 38E of the open-circuit control valve device 38 via signal lines. The controller 41 switches between the switching valves 37B to 37E and the switching valves 38B to 38E based upon a signal from the operating device 11.

The hydraulic excavator 1 of this embodiment is configured as described above, and subsequently, the operation of the hydraulic excavator 1 will be explained.

An on-board operator in the cab 9 starts the engine 19 to drive the closed-circuit hydraulic pump 29 and the open-circuit hydraulic pump 35. In this state, the operator can advance or retreat the lower traveling structure 2 by operating the left and right traveling levers/pedals 11C, 11D. Meanwhile, the operator can perform excavating work of earth and sand by operating the left control lever 11A and the right control lever 11B to rotate the working mechanism 12.

Thus, in this embodiment, the closed-circuit pipe group 30 that constitutes the closed circuit systems 25 to 28 is distributed through upper positions of the closed-circuit hydraulic pump 29 and the open-circuit hydraulic pump 35 along the upper surface plate 22 of the housing 20. Further, the open-circuit pipe group 36 that constitutes the open circuit systems 31 to 34 is distributed through lower positions of the closed-circuit hydraulic pump 29 and the open-circuit hydraulic pump 35 along the revolving frame 8.

Therefore, the arrangement of the closed-circuit pipe group 30 and the open-circuit pipe group 36 can be simplified for distribution. As a result, a space can be formed between the closed-circuit pipe group 30 and the open-circuit pipe group 36.

Consequently, the space between the closed-circuit pipe group 30 and the open-circuit pipe group 36 can be secured as a working space to improve the operational efficiency. The distinct distribution of the closed-circuit pipe group 30 and the open-circuit pipe group 36 can disperse pump pulsation to reduce loads on structures near the closed-circuit pipe group 30 and the open-circuit pipe group 36.

The closed-circuit hydraulic pump 29 is located upward from the open-circuit hydraulic pump 35. As a result, the closed-circuit pipe group 30 can be guided from the upward located closed-circuit hydraulic pump 29 toward the upper surface plate 22 of the housing 20 in the shortest route. In addition, the open-circuit pipe group 36 can be guided from the downward located open-circuit hydraulic pump 35 toward the revolving frame 8 in the shortest route.

As a result, it can be easier to attach and remove the closed-circuit pipe group 30 for the closed-circuit hydraulic pump 29, maintain the closed-circuit hydraulic pump 29 and the like, attach and remove the open-circuit pipe group 36 for the open-circuit hydraulic pump 35 and maintain the open-circuit hydraulic pump 35 and the like. Moreover, the closed-circuit pipe group 30 and the open-circuit pipe group 36 can be shortened, thereby reducing pressure loss in the line.

Further, the foothold 39A that constitutes the working passage 39 facing the closed-circuit hydraulic pump 29 and the open-circuit hydraulic pump 35 is provided between the closed-circuit pipe group 30 and the open-circuit pipe group 36. As a result, the closed-circuit hydraulic pump 29, the open-circuit hydraulic pump 35, the closed-circuit control valve device 37, the open-circuit control valve device 38 and the like can readily be maintained from the foothold 39A of the working passage 39.

Moreover, the embodiments are explained by taking the example where a hydraulic excavator 1 with a backhoe-type working mechanism 12 is illustrated as a construction machine. However, the present invention is not limited to that, and may be widely employed in other types of construction machines such as a hydraulic excavator with a loading shovel-type working mechanism.

DESCRIPTION OF REFERENCE NUMERALS

1: Hydraulic excavator (Construction machine)
6: Revolving device
7: Revolving hydraulic motor (Hydraulic actuator)
8: Revolving frame (Vehicle body frame)
12: Working mechanism
16: Boom cylinder (Hydraulic actuator)
17: Arm cylinder (Hydraulic actuator)
18: Bucket cylinder (Hydraulic actuator)
19: Engine (Prime mover)
20: Housing
22: Upper surface plate (Upper structure)
24: Support frame
25 to 28: Closed circuit system
29: Closed-circuit hydraulic pump
30: Closed-circuit pipe group (One pipe group)
30A: Pump side pipe (Closed-circuit pipe)
30B: Actuator side pipe (Closed-circuit pipe)
31 to 34: Open circuit system
35: Open-circuit hydraulic pump
36: Open-circuit pipe group (The other pipe group)
36A to 36D: Open-circuit pipe
39: Working passage
39A: Foothold

The invention claimed is:

1. A construction machine comprising: a vehicle body frame;

a working mechanism provided on the vehicle body frame;

a prime mover provided on the vehicle body frame;

a housing with an upper structure covering the prime mover from above;

a hydraulic actuator driving the working mechanism;

a closed circuit system including a closed-circuit hydraulic pump driven by the prime mover and a closed-circuit pipe group composed of a plurality of closed-circuit pipes connecting the closed-circuit hydraulic pump and the hydraulic actuator; and an open circuit system including an open-circuit hydraulic pump driven by the prime mover and an open-circuit pipe group composed of a plurality of open-circuit pipes connecting the open-circuit hydraulic pump and the plurality of closed-circuit pipes, wherein one pipe group of the closed-circuit pipe group and the open-circuit pipe group is distributed through upper positions of the closed-circuit hydraulic pump and the open-circuit hydraulic pump along the upper structure, and the other pipe group is distributed through lower positions of the closed-circuit hydraulic pump and the open-circuit hydraulic pump along the vehicle body frame.

2. The construction machine according to claim 1, wherein the closed-circuit hydraulic pump is located upward from the open-circuit hydraulic pump.

3. The construction machine according to claim 2, wherein the one pipe group is the closed-circuit pipe group and the other pipe group is the open-circuit pipe group.

4. The construction machine according to claim 1, wherein a support frame composed of a strength member is provided on the upper structure, wherein the one pipe group is supported by the support frame.

5. The construction machine according to claim 1, wherein a foothold that constitutes a working passage facing the closed-circuit hydraulic pump and the open-circuit hydraulic pump is provided between the one pipe group and the other pipe group.

* * * * *